US012618350B2

(12) United States Patent
Troeger

(10) Patent No.: US 12,618,350 B2
(45) Date of Patent: May 5, 2026

(54) MIXER ARRANGEMENT FOR MIXING AN INJECTION MEDIUM INJECTABLE BY AN INJECTOR WITH THE EXHAUST GAS OF AN INTERNAL COMBUSTION ENGINE

(71) Applicants: DEUTZ Aktiengesellschaft, Cologne (DE); Deere & Company, Moline, IL (US)

(72) Inventor: Adrian Troeger, Troisdorf (DE)

(73) Assignees: Deutz Aktiengesellschaft, Cologne (DE); Deere & Company, Moline, IL (US)

( * ) Notice: Subject to any disclaimer, the term of this patent is extended or adjusted under 35 U.S.C. 154(b) by 0 days.

(21) Appl. No.: 18/890,470

(22) Filed: Sep. 19, 2024

(65) Prior Publication Data

US 2025/0101895 A1 Mar. 27, 2025

(30) Foreign Application Priority Data

Sep. 22, 2023 (DE) ..... 102023125729.3

(51) Int. Cl.
*F01N 3/20* (2006.01)

(52) U.S. Cl.
CPC ..... *F01N 3/206* (2013.01); *F01N 3/208* (2013.01); *F01N 2240/20* (2013.01); *F01N 2610/02* (2013.01); *F01N 2610/1453* (2013.01)

(58) Field of Classification Search
CPC ..... F01N 3/206; F01N 3/208; F01N 2240/20; F01N 2610/02; F01N 2610/1453
See application file for complete search history.

(56) References Cited

U.S. PATENT DOCUMENTS

| | | | | |
|---|---|---|---|---|
| 3,819,208 | A * | 6/1974 | Janle | F16L 59/18 285/55 |
| 8,966,965 | B2 * | 3/2015 | Driscoll | F01N 3/208 73/114.71 |
| 9,352,276 | B2 * | 5/2016 | Sampath | B01F 25/4521 |
| 10,179,315 | B2 * | 1/2019 | Brandl | B01F 25/3141 |
| 10,690,034 | B2 * | 6/2020 | Sandou | F01N 3/035 |
| 2003/0079467 | A1 * | 5/2003 | Liu | B01F 25/45211 60/286 |

(Continued)

FOREIGN PATENT DOCUMENTS

| | | |
|---|---|---|
| DE | 102016004333 A1 | 10/2017 |
| DE | 102022121578 A1 | 3/2023 |

(Continued)

*Primary Examiner* — Matthew T Largi
(74) *Attorney, Agent, or Firm* — Davidson Kappel LLC

(57) ABSTRACT

A mixer arrangement for mixing an injection medium injectable by an injector with the exhaust gas of an internal combustion engine, includes a first exhaust gas guide section and a second exhaust gas guide section, through each of which the exhaust gas of the internal combustion engine can be guided, and a mixing pipe which fluidically connects the first exhaust gas guide section to the second exhaust gas guide section. The mixing pipe has an opening, through which the injection medium from the injector can be injected into the mixing pipe. A sleeve element surrounds the mixing pipe at least in sections, so that a gap is formed between the sleeve element and the mixing pipe. The gap is fluidically connected to the first exhaust gas guide section.

9 Claims, 8 Drawing Sheets

(56) References Cited

U.S. PATENT DOCUMENTS

| | | | | |
|---|---|---|---|---|
| 2013/0104531 | A1* | 5/2013 | Cho | B01F 25/3141 60/302 |
| 2014/0334987 | A1* | 11/2014 | Stanavich | F01N 13/009 422/168 |
| 2015/0071825 | A1* | 3/2015 | Sampath | B01D 53/92 422/168 |
| 2016/0069239 | A1* | 3/2016 | Freeman | F01N 13/1888 60/324 |
| 2021/0115829 | A1 | 4/2021 | Kast et al. | |
| 2021/0199038 | A1* | 7/2021 | Panunzio | B01F 25/43151 |
| 2022/0235687 | A1* | 7/2022 | Larsen | F01N 13/009 |
| 2023/0061888 | A1* | 3/2023 | Geant | F01N 3/2066 |

FOREIGN PATENT DOCUMENTS

| | | | |
|---|---|---|---|
| EP | 3808949 | A1 | 4/2021 |
| WO | WO 2016/195574 | A1 | 12/2016 |

* cited by examiner

MIXER ARRANGEMENT FOR MIXING AN INJECTION MEDIUM INJECTABLE BY AN INJECTOR WITH THE EXHAUST GAS OF AN INTERNAL COMBUSTION ENGINE

CROSS REFERENCE TO RELATED APPLICATION

This claims the benefit of a German Patent Application DE 102023125729.3, filed on Sep. 22, 2023, which is hereby incorporated by reference herein.

TECHNICAL FIELD

The present disclosure relates to a mixer arrangement for mixing an injection medium injectable by an injector with the exhaust gas of an internal combustion engine.

BACKGROUND

Reactants are introduced into the exhaust gas flow for the after-treatment of exhaust gases, so that environmentally harmful components in the exhaust gas are reduced. In diesel internal combustion engines, for example, a urea-water solution is injected into the exhaust gas in order to reduce the proportion of nitrogen oxide in the exhaust gas in a downstream SCR catalytic converter arrangement. A mixer arrangement can be arranged upstream of the catalytic converter arrangement, which mixes the reactant injected into the exhaust gas flow with the exhaust gas in order to improve the effectiveness of the catalytic converter.

A mixer arrangement for an internal combustion engine is known from EP 3 808 949 A1, comprising: a base element, wherein a reactant input opening is formed in the base element, which is open in the direction of a radially expanding reactant receiving volume, and a swirl generating element connected to the base element, wherein a mixing volume adjoining the reactant receiving volume is formed in the swirl generating element and a plurality of exhaust gas passage openings following one another in the circumferential direction is provided in the swirl generating element. A plurality of exhaust gas passage channels are provided in the base element, which are arranged in succession in the circumferential direction and are open to the reactant intake volume. The arrangement is intended to reduce the risk of deposits forming on the reactant and improve mixing behavior.

SUMMARY

An object of the present disclosure is to provide a mixer arrangement for mixing an injection medium injectable by an injector with the exhaust gas of an internal combustion engine, which minimizes the deposition of the injection medium in the mixer arrangement in a simple manner.

To achieve an object, a mixer arrangement is proposed for mixing an injection medium injectable by an injector with the exhaust gas of an internal combustion engine, comprising: a first exhaust gas guide section and a second exhaust gas guide section, through each of which the exhaust gas of the internal combustion engine can be guided, a mixing pipe which fluidically connects the first exhaust gas guide section to the second exhaust gas guide section, the mixing pipe having an opening through which the injection medium can be injected from the injector into the mixing pipe. A sleeve element is also provided, which surrounds the mixing pipe at least partially, so that a gap is formed between the sleeve element and the mixing pipe, the gap being fluidically connected to the first exhaust gas guide section.

The advantage of the mixer arrangement is that the exhaust gas can enter the gap between the mixing pipe and the sleeve element without the injection medium being mixed in, where it can effectively transfer the thermal energy contained in the exhaust gas to the mixing pipe. The mixing pipe is heated evenly due to the continuous flow of hot exhaust gas around it and local cold spots on the inner wall of the mixing pipe, where liquid injection medium can crystallize and deposit, are avoided.

In a possible embodiment, the mixing pipe can comprise a cylinder section. The sleeve element can comprise a cylinder section. The cylinder section of the sleeve element can surround the cylinder section of the mixing pipe, at least partially.

The gap can be designed as a narrow, elongated opening forming an intermediate space between the mixing pipe and the sleeve element. The gap between the mixing pipe and the sleeve element can be designed as a closed annular gap, at least partially. The gap can be fluidically connected to the second exhaust gas guide section. Alternatively, or in combination, the gap can be fluidically connected to the second exhaust gas guide section via the mixing pipe.

In a possible embodiment, the sleeve element can have contact sections with which the sleeve element is seated on the mixing pipe. The sleeve element can only be in contact with the mixing pipe with the contact sections. In particular, the contact sections can be designed as spring tabs. A first spring tab can be arranged at a first axial end of the sleeve element. Alternatively or in combination, a second spring tab can be arranged at an opposite second axial end of the sleeve element.

In a further possible embodiment, the mixing pipe can have at least one cutout via which the first exhaust gas guide section is fluidically connected to the gap.

BRIEF SUMMARY OF THE DRAWINGS

In the following, an embodiment of a mixer arrangement is explained in more detail with reference to the figures. Herein

DETAILED DESCRIPTION

Figure 1:
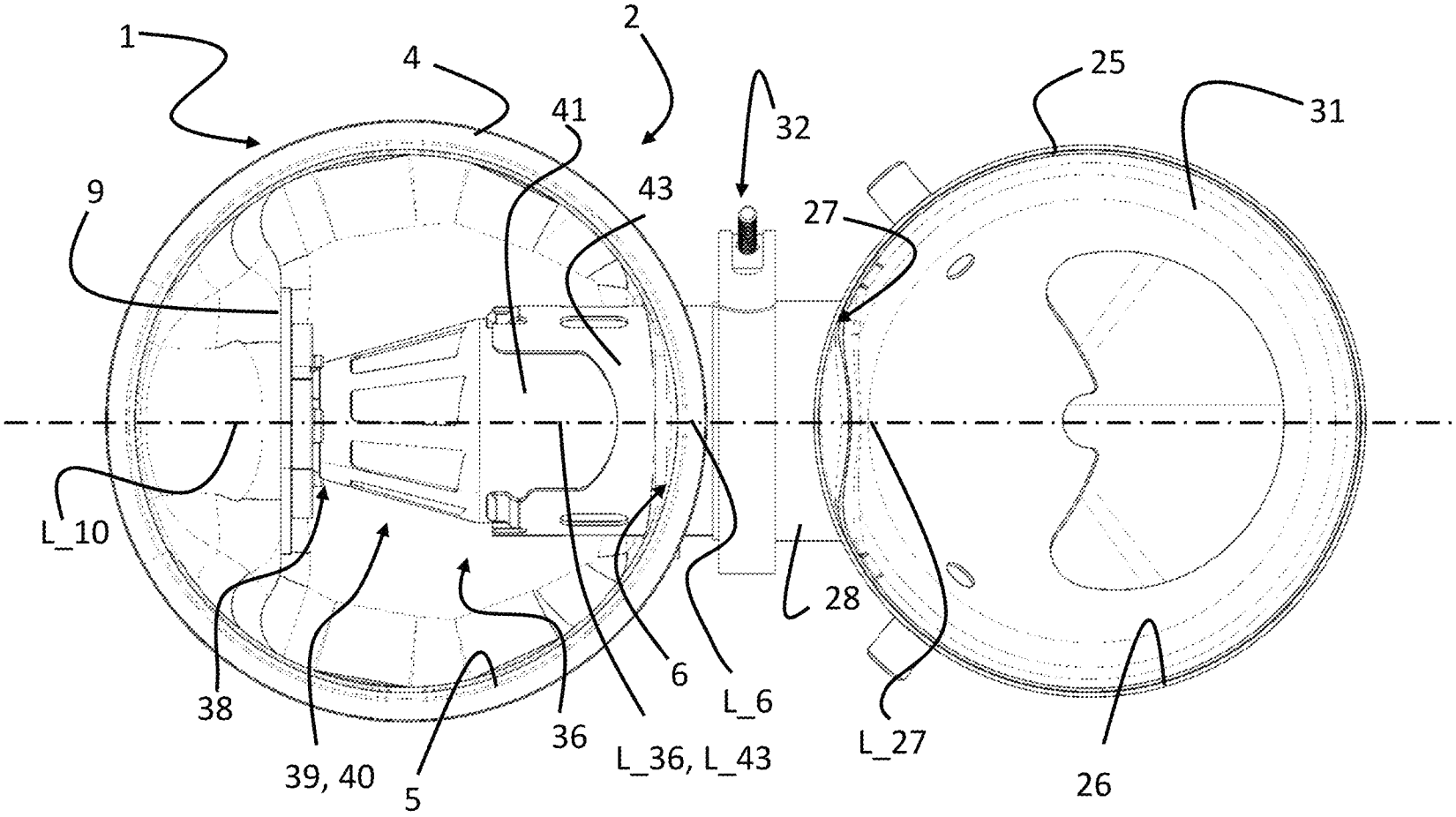
FIG. 1 shows a side view of an exhaust gas aftertreatment arrangement with a mixer arrangement.
Figure 2:
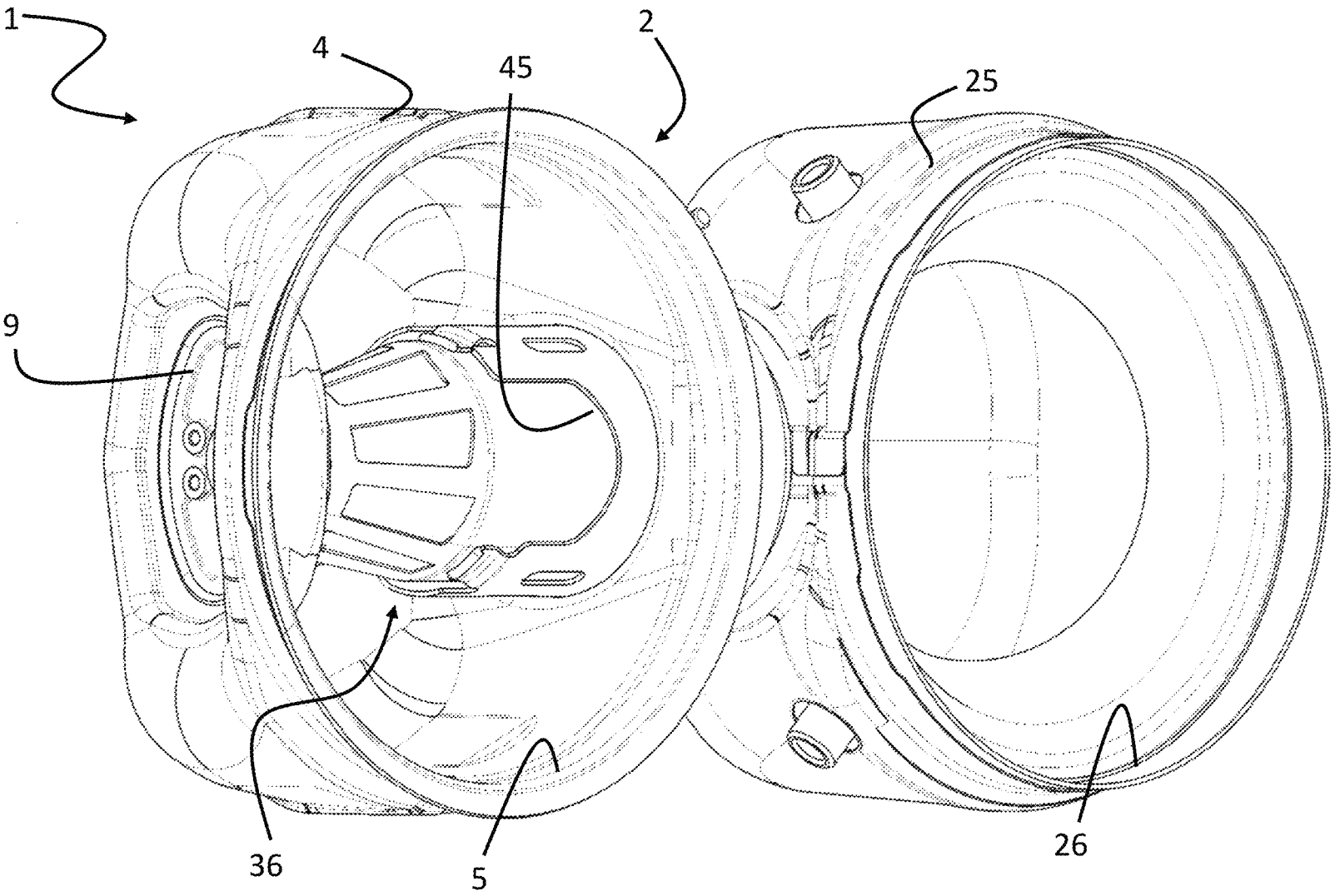
FIG. 2 shows a perspective view of the exhaust gas aftertreatment arrangement from FIG. 1.
Figure 3:
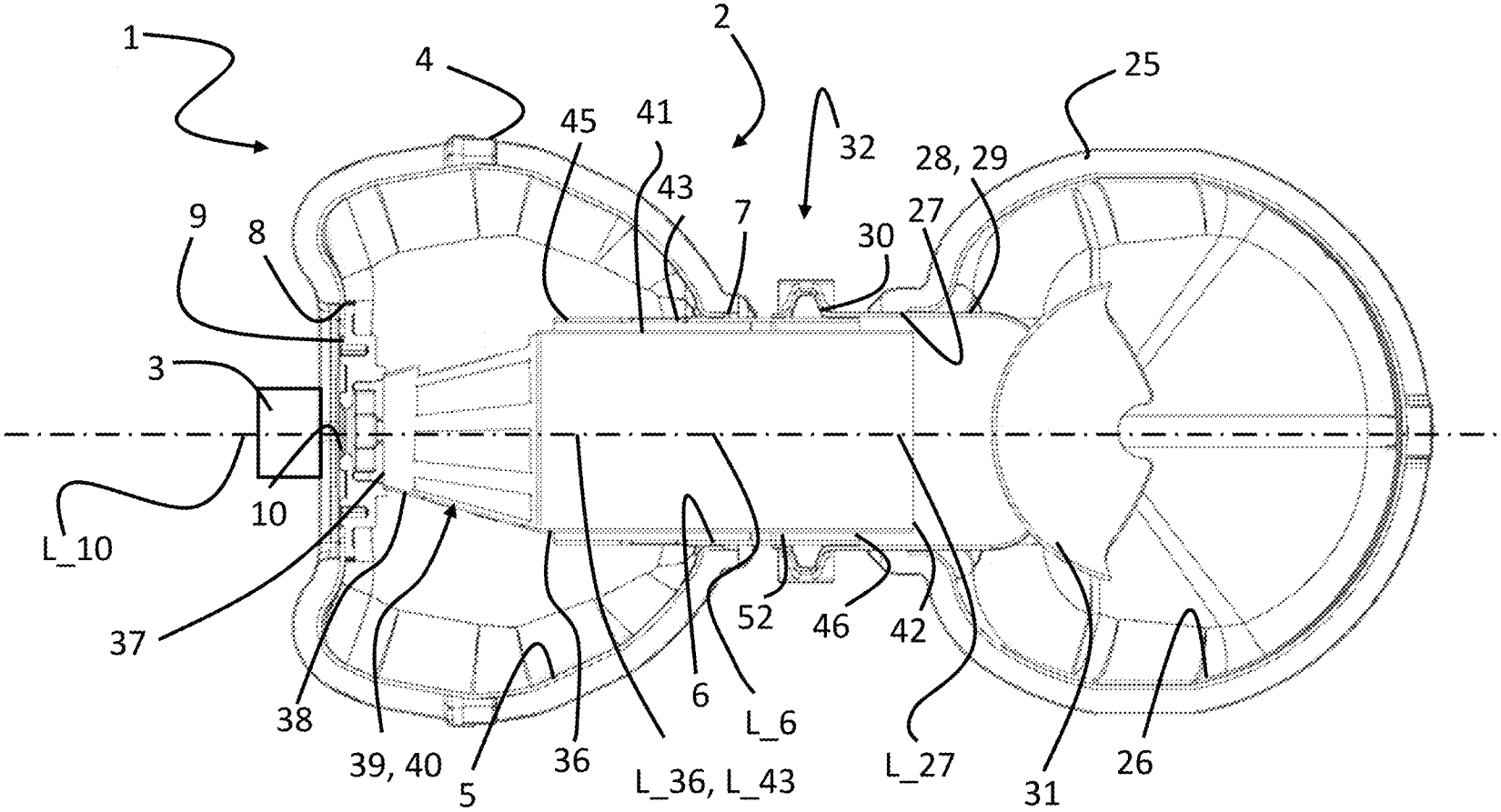
FIG. 3 shows a longitudinal section through the mixer arrangement from FIG. 1.
Figure 4:
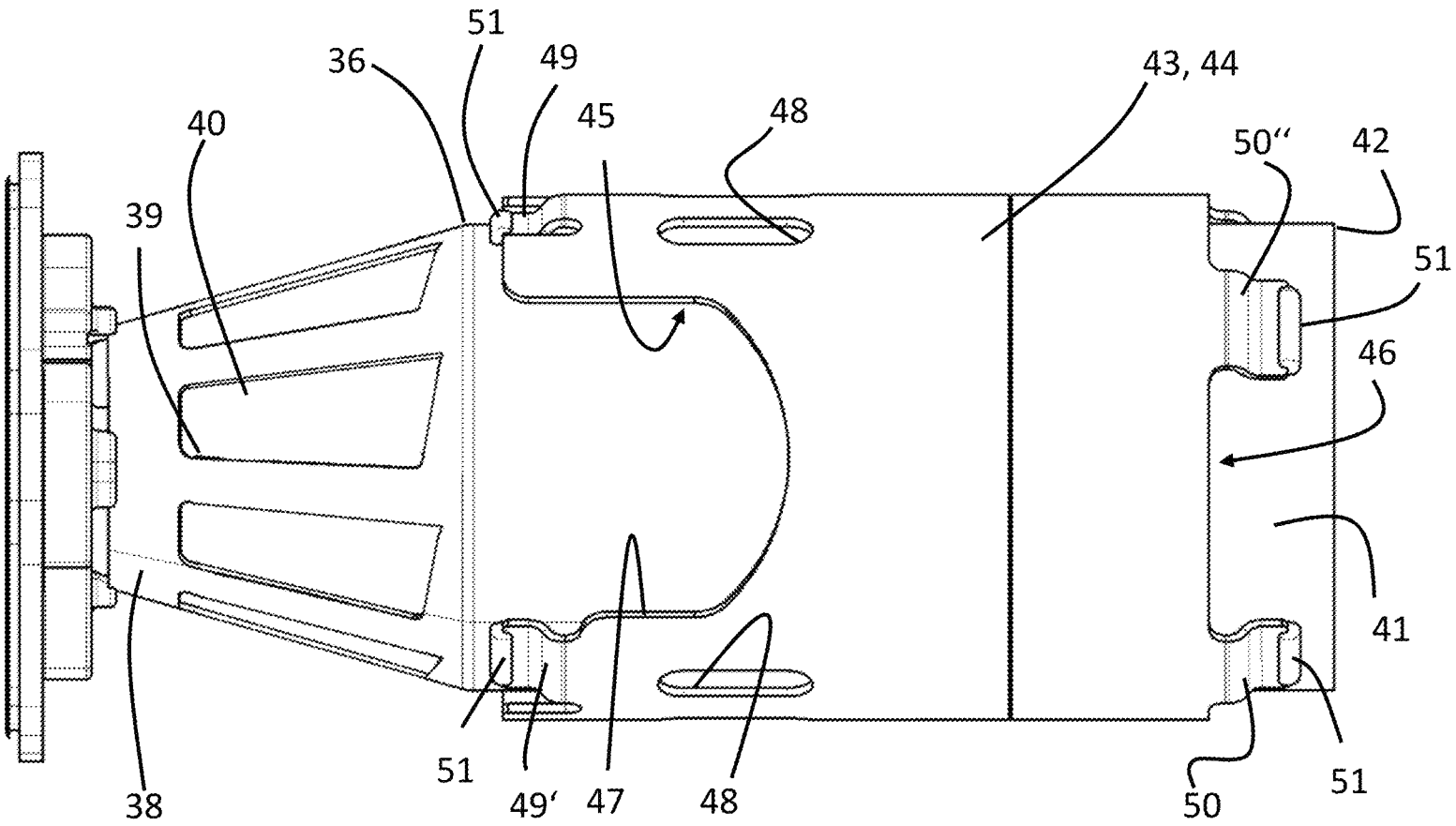
FIG. 4 shows a side view of the flange element, the mixing pipe and the sleeve element from FIG. 1.
Figure 5:
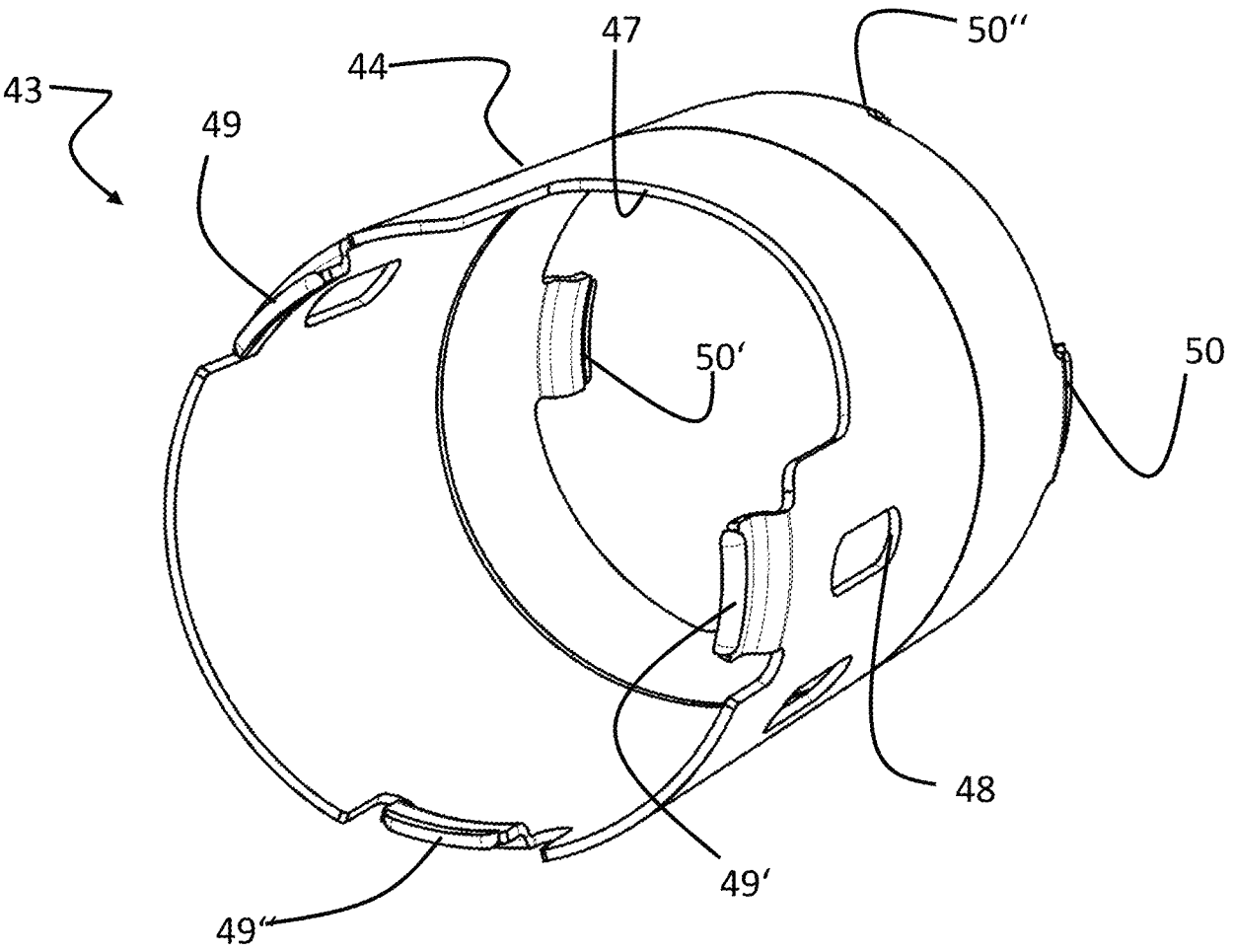
FIG. 5 shows a perspective view of the sleeve element from FIG. 1.
Figure 6:
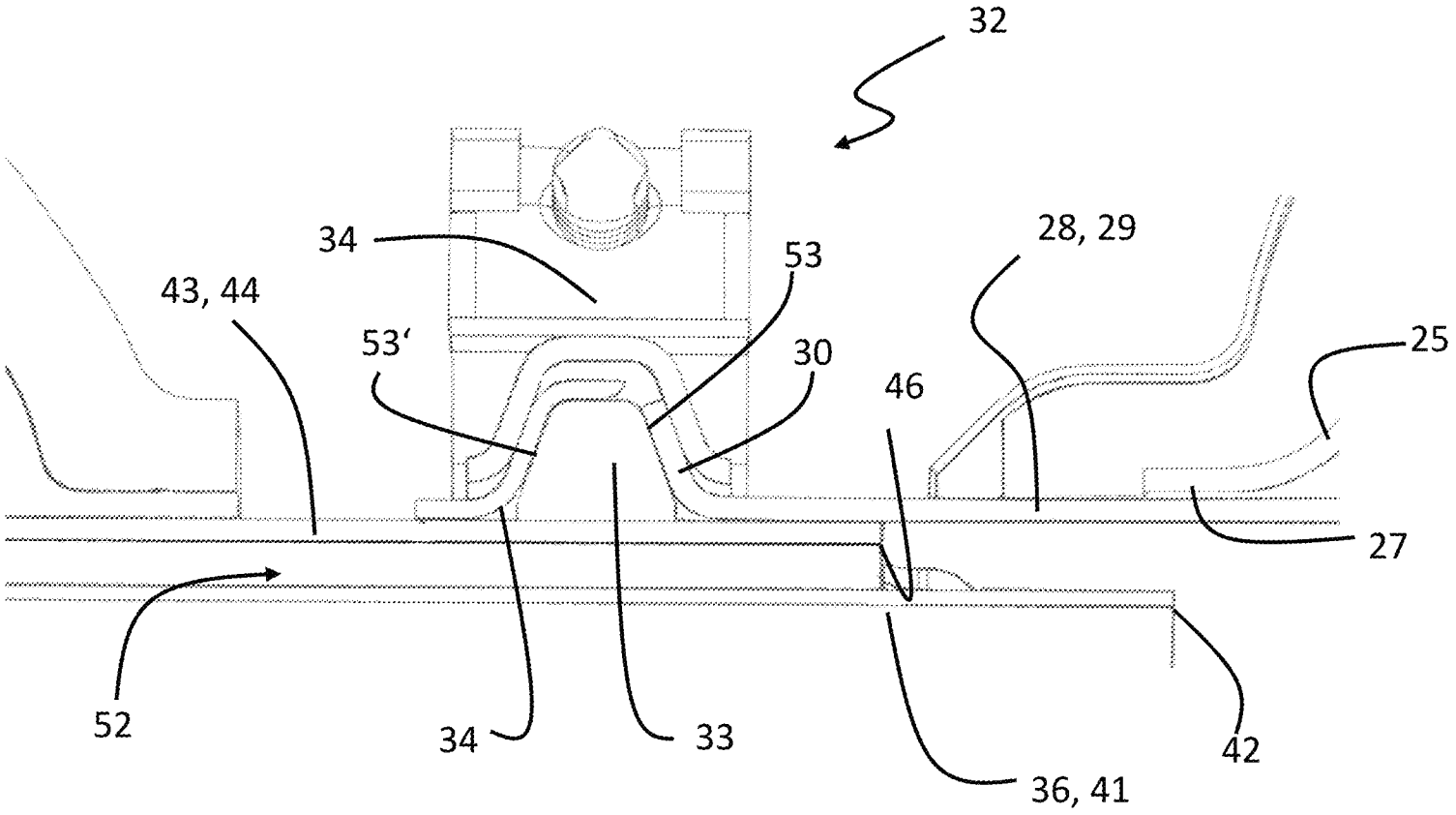
FIG. 6 shows an enlarged view of detail VI from FIG. 3.

FIGS. 1 to 6, which are described together below, show a part of an exhaust gas aftertreatment arrangement 1 of an internal combustion engine with a mixer arrangement 2 for mixing an injection medium injectable by an injector 3 with the exhaust gas of the internal combustion engine. In the present case, a water-urea solution is injected into the exhaust gas through the injector 3 as an injection medium and mixed with it to reduce the nitrogen oxide content in the exhaust gas. The exhaust gas is then fed to a catalytic converter, not shown, in which the nitrogen oxides contained in the exhaust gas are converted into water and nitrogen by means of selective catalytic reduction.

The mixer arrangement 2 comprises a first exhaust gas guide section 4, which can also be referred to as the first exhaust gas guide element. The first exhaust gas guide section 4 is essentially cup-shaped and has a circular connection opening 5, via which the first exhaust gas guide section 4 can be fluidically connected to an upstream section of the exhaust gas aftertreatment arrangement 1, which is not shown. The upstream section of the exhaust gas aftertreatment arrangement 1 can be a particulate filter, for example. The imaginary normal on the connection opening 5 defines the main inflow direction of the exhaust gas into the first exhaust gas guide section 4.

The first exhaust gas guide section 4 also comprises an insert opening 8, in which a flange element 9 is arranged. The first exhaust gas guide section 4 and the flange element 9 are firmly connected to each other, in particular welded. The flange element 9 comprises an injection opening 10, which extends along an injection axis L_10 and via which the injector 3 can inject the injection medium into the interior of the first exhaust gas guide section 4. For this purpose, the injector 3 is firmly connected, in particular screwed, to the flange element 9 on a side of the flange element 9 facing away from the interior of the first exhaust gas guide section 4.

A mixing pipe 36, which extends along a longitudinal axis L_36, is arranged in the interior of the first exhaust gas guide section 4. The longitudinal axis L_36 is arranged transversely, in particular orthogonally, to the main inflow direction of the exhaust gas into the first exhaust gas guide section 4. The longitudinal axis L_36 is also arranged coaxially to the injection axis L_10. The mixing pipe 36 has an injection opening 37 at a first axial end, which is oriented in the direction of the injection opening 10 of the flange element 9. In other words, the injection opening 37 and the injection opening 10 are opposite each other. The injector 3 thus injects the injection medium into the mixing pipe 36. The mixing pipe 36 engages in recesses of the flange element 9 so that the mixing pipe 36 is supported at the first axial end of the flange element 9 in the axial and radial direction.

The mixing pipe 36 can be designed as a formed sheet metal part. The mixing pipe 36 comprises a swirl section 38, which is designed to provide the incoming exhaust gas with an axial and radial swirl component, so that improved mixing of the exhaust gas and injection medium in the mixing pipe 36 can be achieved. The swirl section 38 extends from the injection opening 37 along the longitudinal axis L_36 and widens conically with increasing distance from the injection opening 37.

In the area of the swirl section 38, the mixing pipe 36 has several inlet openings 39 distributed around the circumference, through which the exhaust gas from the internal combustion engine can enter the mixing pipe 36. In other words, the mixing pipe 36 is fluidically connected to the first exhaust gas guide section 4 via the inlet openings 39. The inlet openings 39 are each delimited partially by a guide vane 40, which is shaped in such a way that the exhaust gas from the internal combustion engine enters the swirl section 38 with a swirl.

A cylinder section 41 in the form of a cylindrical tube adjoins the swirl section 38 in the direction of the longitudinal axis L_36 of the mixing pipe 36. The cylinder section 41 may also be referred to as mixing section or evaporator section. The cylinder section 41 comprises an outlet opening 42 of the mixing pipe 36 at its second axial end.

The cylinder section 41 extends through a passage opening 6 of the first exhaust gas guide section 4, which extends along a passage axis L_6. The passage axis L_6 of the passage opening 6 and the longitudinal axis L_36 of the mixing pipe are arranged coaxially to each other. The cylinder section 41 extends into a second exhaust gas guide section 25, which can also be referred to as the second exhaust gas guide element. The second exhaust gas guide section 25 is arranged downstream of the first exhaust gas guide section 4. The mixing pipe 36 thus fluidically connects the first exhaust gas guide section 4 with the second exhaust gas guide section 25. The connection between the first exhaust gas guide section 4 and the second exhaust gas guide section 25 is detachable.

The cylinder section 41 is surrounded in sections by a sleeve element 43, which extends along a longitudinal axis L_43. It is also conceivable that the cylinder section 41 is completely surrounded by the sleeve element along the longitudinal axis L_43. The longitudinal axis L_43 of the sleeve element 43 is arranged coaxially to the longitudinal axis L_36 of the mixing pipe 36. The sleeve element 43 also extends from the interior of the first exhaust gas guide section 4 through the passage opening 6 of the first exhaust gas guide section 4. In other words, the sleeve element 43 is arranged between the first exhaust gas guide section 4 and the mixing pipe 36.

The outer surface of the sleeve element 43 is arranged at least partially in the interior of the first exhaust gas guide section 4. In other words, the sleeve element 43 is arranged in the interior of the first exhaust gas guide section 4 in such a way that the hot exhaust gas can flow around the outer surface of the sleeve element 43, at least partially.

An annular sealing element 7 is arranged between the sleeve element 43 and the first exhaust gas guide section 4 in the area of the passage opening 6, so that the interior of the first exhaust gas guide section 4 is sealed off from the surroundings. Since the sealing element 7 prevents direct contact between the sleeve element 43 and the first exhaust gas guide section 4, the exchange of thermal energy between the sleeve element 43 and the first exhaust gas guide section 4 is inhibited. The sealing element 7 can therefore also be referred to as the first thermally insulating insulation arrangement.

Between the sleeve element 43 and the mixing pipe 36, a narrow, elongated opening forming an intermediate space is formed, which can be referred to as gap 52. The gap 52 extends between an inlet opening 45 and an outlet opening 46, which are each formed between the mixing pipe 36 and the sleeve element 43. The gap 52 is fluidically connected to the first exhaust gas guide section 4 via the inlet opening 45. The gap 52 is fluidically connected to the second exhaust gas guide section 25 via the outlet opening 46. In principle, it is also conceivable that the gap 52 is optionally fluidically connected to the mixing pipe 36.

The gap 52 thus fluidically connects the first exhaust gas guide section 4 with the second exhaust gas guide section 25. The hot exhaust gas from the internal combustion engine can enter the gap 52 from the interior of the first exhaust gas guide section 4 via the inlet opening 45 and flow through it in the direction of the second exhaust gas guide section 25. The hot exhaust gas effectively transfers the thermal energy it contains to the mixing pipe 36 and heats it evenly. This prevents colder spots in the mixing pipe 36 where the injection medium can condense and subsequently deposit.

The sleeve element 43 has a cylinder section 44, which is in the form of a closed cylinder tube. The cylinder section 44 of the sleeve element 43 fully encloses the cylinder section 41 of the mixing pipe 36, at least in sections. The gap 52 is thus formed in the shape of a closed annular gap, at least partially.

The sleeve element 43 has a main inlet cutout 47 and one or more secondary inlet cutouts 48 in the cylinder section 44, which together enlarge the inlet opening 45 and thus ensure an improved supply of hot exhaust gas into the gap 52.

The main inlet cutout 47 extends from the first axial end of the sleeve element 43 arranged in the interior of the first exhaust gas guide section 4 in the shape of a slot in a direction parallel to the longitudinal axis L_43, so that the surface of the cylinder section 41 of the mixing pipe 36, which is opposite the main inlet direction of the exhaust gas into the first exhaust gas guide section 4 in the interior of the first exhaust gas guide section 4, is arranged without overlap with the sleeve element 43, at least partially. The hot exhaust gas can therefore flow directly onto the aforementioned surface of the cylinder section 41.

The multiple secondary inlet cutouts 48 are designed as elongated holes that are distributed around the circumference of the sleeve element 43 in the interior of the first exhaust gas guide section 4. It is understood that only one secondary inlet opening 48 can be provided.

The sleeve element 43 has first contact sections at the first axial end arranged in the interior of the first exhaust gas guide section 4 and second contact sections at the opposite second axial end, with which the sleeve element 43 is seated on the mixing pipe 36 in each case. The first contact sections and second contact sections are each designed as first spring tabs 49 and second spring tabs 50, respectively, distributed around the circumference. In the present case, three first spring tabs 49, 49', 49" are distributed evenly around the circumference and three second spring tabs 50, 50', 50" are distributed around the circumference without being limited to the exact number. One of the first spring tabs 49" and one of the second spring tabs 50" lie in a common first longitudinal plane, which comprises the longitudinal axis L_43 of the sleeve element. In addition, two second spring tabs 50, 50' lie in a common second longitudinal plane, which comprises the longitudinal axis L_43 of the sleeve element. The first longitudinal plane and the second longitudinal plane are arranged transversely, in particular orthogonally, to each other.

The sleeve element 43 is initially pushed onto the cylinder section 41 of the mixing pipe 36, so that the sleeve element 43 is in contact with the cylinder section 41 of the mixing pipe 36 only with the first spring tabs 49 and the second spring tabs 50, respectively. Subsequently, the spring tabs 49, 50 can be firmly connected to the cylinder section 41 of the mixing pipe 36 by means of weld seams 51.

It is also conceivable that only one of the first contact sections and the second contact sections is provided. In particular, the first spring tabs 50 could be omitted in the present case. The sleeve element 43 would then still be sufficiently positioned and fixed via the connecting arrangement 32 and the second spring tabs 50.

The outlet opening 42 of the mixing pipe 36 is spaced from the outlet opening 46 of the sleeve element 43 in the axial direction. In particular, the distance is at least half the radius of the cylinder section 41 of the mixing pipe 36. This prevents the exhaust gas mixed with the injection medium from flowing back from the outlet opening 42 of the mixing pipe 36 into the overlap area of the sleeve element 43 and connecting pipe 28, where it can penetrate into the gap between the sleeve element 43 and connecting pipe 28 in the direction of the graphite ring 33. This effect is intensified by the fact that the hot exhaust gas flowing out of the gap 52 in the direction of the second exhaust gas guide section drives the exhaust gas injection medium mixture away from the graphite ring 33.

The mixer arrangement 2 comprises a second exhaust gas guide section 25, which can also be referred to as a second exhaust gas guide element. The second exhaust gas guide section 25 is essentially cup-shaped and has a circular connection opening 26, via which the second exhaust gas guide section 25 can be fluidically connected to a downstream section of the exhaust gas aftertreatment arrangement 1, which is not shown. The downstream section of the exhaust gas aftertreatment arrangement 1 can be an SCR catalytic converter, for example.

The second exhaust gas guide section 25 has a passage opening 27, which extends along a passage axis L_27. The passage axis L_27 of the passage opening 27 and the longitudinal axis L_36 of the mixing pipe 36 are arranged coaxially to one another. The second exhaust gas guide section comprises a connecting pipe 28, which extends along a longitudinal axis L28 through the passage opening 27. The passage axis L_27 of the passage opening 27 and the longitudinal axis L_28 of the connecting pipe 28 are arranged coaxially to each other. The connecting pipe 28 extends from an interior of the second exhaust gas guide section 25 through the passage opening 27. The connecting pipe 28 has a cylinder section 29 and an adjoining conical section 30, with the conical section forming an axial end of the connecting pipe 28. In the area of the passage opening 27, the cylinder section 29 of the connecting pipe 28 and the second exhaust gas guide section 25 are firmly connected to each other.

The connecting pipe 28 encloses the mixing pipe 36 and the sleeve element 43 at least partially. In other words, the respective axial end of the mixing pipe 36 or the sleeve element 43 arranged outside the interior of the first exhaust gas guide section 4 extends into the connecting pipe 28.

The connecting pipe 28 and the sleeve element 43 are detachably connected to each other by a connecting arrangement 32, so that the connecting pipe 28 and the sleeve element 43 are arranged coaxially to each other. The connecting arrangement 32 connects the connecting pipe 28 and the sleeve element 43 in an area outside the first exhaust gas guide section 4 and the second exhaust gas guide section 25.

The connection arrangement 32 comprises a graphite sealing ring 33, which surrounds the cylinder section 44 of the sleeve element 43 in sealing contact. The graphite sealing ring 33 has a trapezoidal cross-section. The conical section 30 of the connecting pipe 28 is in contact with a first leg side 53 of the graphite sealing ring 33. On the opposite second leg side 53', the graphite sealing ring 33 is in contact with a conical section of a connecting ring 34. The connecting ring 34 further comprises a first substantially cylindrical tubular portion which adjoins the conical portion on a first side and is in abutment with the radially outwardly directed surface of the graphite scaling ring 33, and a second substantially cylindrical tubular portion which adjoins the conical portion on a second side and is in abutment with the sleeve element 43.

The connecting arrangement 32 further comprises a clamping clip 35, which radially encloses the conical section 30 of the connecting pipe 28, the connecting ring 34 and the graphite sealing ring 33. In the present case, the clamping clip 35 is designed as a V-band clamp, which, as is known, comprises a clamping band with internal V- or U-shaped circular ring segments. By tightening the clamping clip 35, the conical section 30 of the connecting pipe 28, the connecting ring 34 and the graphite sealing ring 33 are radially clamped together so that the sleeve element 43 and the connecting pipe 28 are connected to each other by force and/or friction. Since the connecting arrangement 32 prevents direct contact between the connecting pipe 28 and the sleeve element 43, the exchange of thermal energy between the connecting pipe 28 and the sleeve element 43 is inhibited. The connecting arrangement 32 can therefore also be referred to as a second thermally insulating insulation arrangement.

Figure 7:
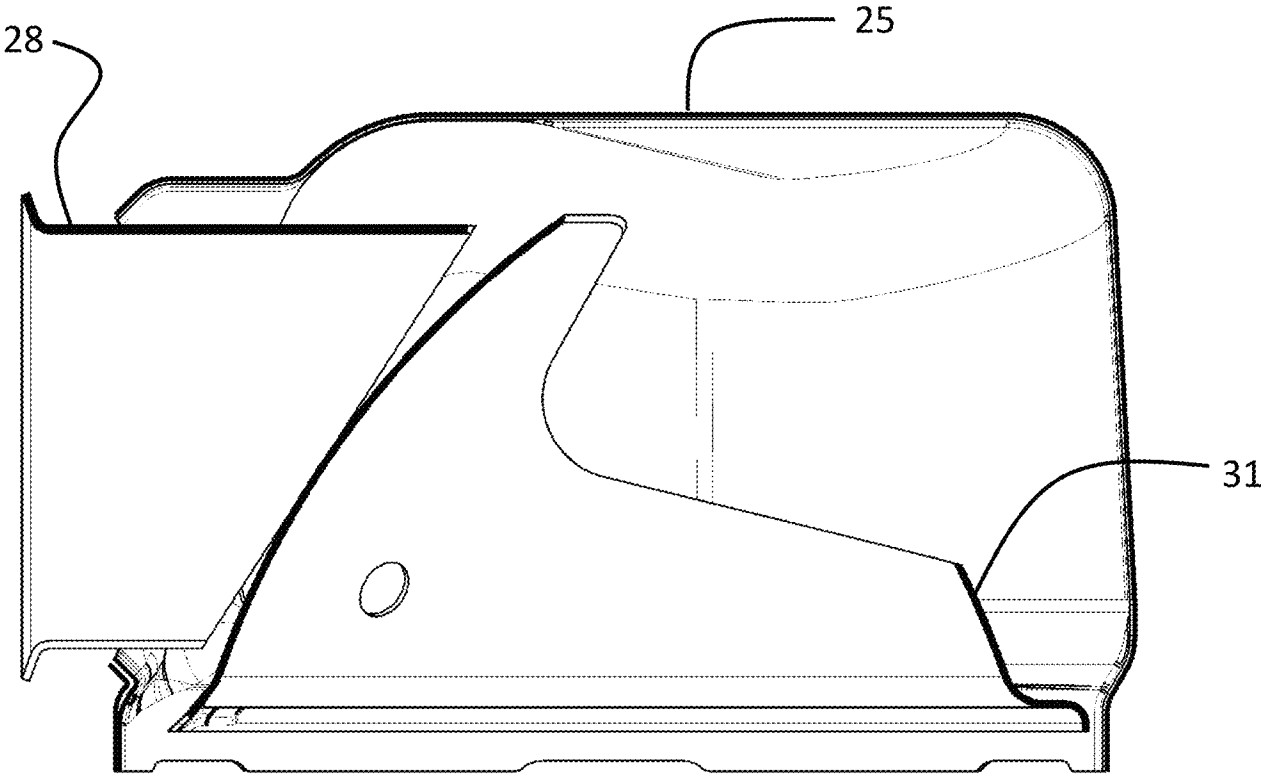
FIG. 7 shows a sectional view showing schematically the arrangement of the connecting pipe and guide plate in the second exhaust gas guide section.
Figure 8:
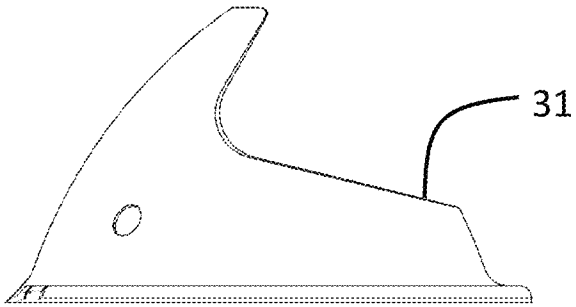
FIG. 8 shows a first side view of the guide plate.
Figure 9:
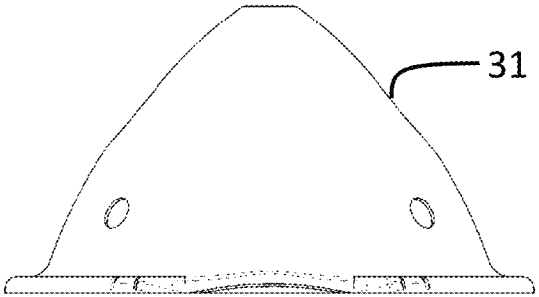
FIG. 9 shows a second side view of the guide plate.
Figure 10:
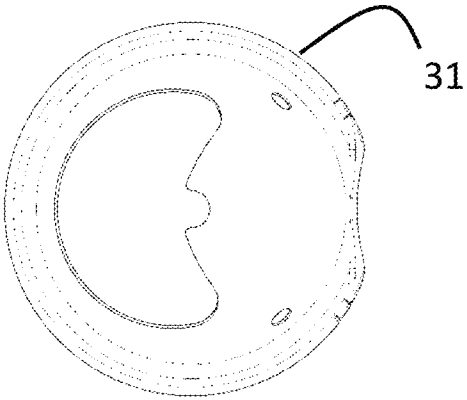
FIG. 10 shows a top view of the guide plate.
Figure 11:
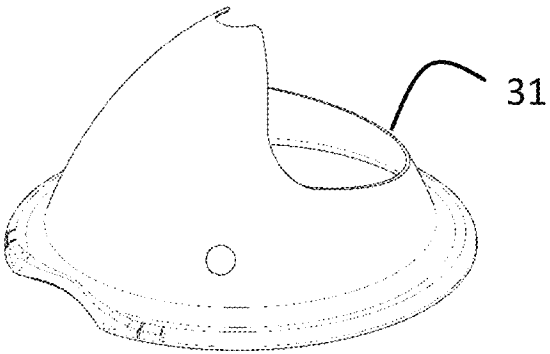
FIG. 11 shows a perspective view of the baffle plate.

A baffle plate 31 is arranged in the interior of the second exhaust gas guide section 25, which optimizes the flow of the exhaust gas before it enters the SCR catalytic converter. The structure and arrangement of the baffle plate 31 can be seen in detail in FIGS. 7 to 11.

What is claimed is:

1. A mixer arrangement for mixing an injection medium injectable by an injector with exhaust gas of an internal combustion engine, comprising:

a first exhaust gas guide section and a second exhaust gas guide section, through each of which the exhaust gas from the internal combustion engine is guidable;

a mixing pipe fluidically connecting the first exhaust gas guide section to the second exhaust gas guide section, wherein the mixing pipe has an opening through which the injection medium is injectable from the injector into the mixing pipe; and a sleeve element surrounding the mixing pipe at least partially, so that a gap is formed between the sleeve element and the mixing pipe, wherein the gap is fluidically connected to the first exhaust gas guide section, the mixing pipe being longer than the sleeve element, wherein the sleeve element has contact sections with which the sleeve element is seated on the mixing pipe, the sleeve element being in contact with the mixing pipe only with the contact sections, wherein the contact sections are designed as a plurality of spring tabs.

2. The mixer arrangement according to claim 1 wherein the mixing pipe comprises a cylinder section, and wherein the sleeve element comprises a cylinder section that surrounds the cylinder section of the mixing pipe at least partially.

3. The mixer arrangement according to claim 1, wherein the gap between the mixing pipe and the sleeve element is a closed annular gap.

4. The mixer arrangement according to claim 1, wherein the gap is fluidically connected to the second exhaust gas guide section directly and/or via the mixing pipe.

5. The mixer arrangement according to claim 1, wherein a first spring tab of said plurality of spring tabs is arranged at a first axial end of the sleeve element.

6. The mixer arrangement according to claim 1, wherein the sleeve element is connected to the first exhaust gas guide section via a first thermally insulating insulation arrangement, and/or wherein the sleeve element is connected to the second exhaust gas guide section via a second thermally insulating insulation arrangement.

7. The mixer arrangement according to claim 1, wherein the spring tabs are formed integrally with the sleeve element and are bent inward from the sleeve element.

8. The mixer arrangement according to claim 5, wherein the first spring tab forms an axial endpoint of the sleeve element.

9. The mixer arrangement according to claim 8, wherein a second spring tab of said plurality of spring tabs is arranged at an opposite second axial end of the sleeve element wherein the second spring tab forms a further axial endpoint of the sleeve element.

* * * * *